US009974371B2

(12) United States Patent
Brandes et al.

(10) Patent No.: US 9,974,371 B2
(45) Date of Patent: May 22, 2018

(54) METHODS AND DEVICES FOR SUPERVISING BAGGAGE ITEMS

(71) Applicant: TELEFONAKTIEBOLAGET L M ERICSSON (PUBL), Stockholm (SE)

(72) Inventors: Henning Brandes, Aachen (DE); Mikael Lars Roland Boman, Aachen (DE); Karsten George, Herzogenrath (DE); Laura Spycher, Kreuzau (DE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days. days.

(21) Appl. No.: 14/340,485

(22) Filed: Jul. 24, 2014

(65) Prior Publication Data

US 2015/0029026 A1 Jan. 29, 2015

(30) Foreign Application Priority Data

Jul. 25, 2013 (EP) ..... 13178057

(51) Int. Cl.
*A45C 13/18* (2006.01)
*G08B 13/08* (2006.01)
(Continued)

(52) U.S. Cl.
CPC ..... *A45C 13/18* (2013.01); *G08B 13/08* (2013.01); *G08B 13/126* (2013.01); *G08B 13/14* (2013.01);
(Continued)

(58) Field of Classification Search
CPC .... A45C 13/18; G08B 13/08; G08B 21/0263; G08B 21/0269; G08B 21/0275; G08B 25/08
(Continued)

(56) References Cited

U.S. PATENT DOCUMENTS 5,831,531 A 11/1998 Tuttle
5,963,131 A * 10/1999 D'Angelo ..... G08B 13/1409 340/328
(Continued)

FOREIGN PATENT DOCUMENTS

CA 2704244 A1 11/2011
CN 201474552 U 5/2010
(Continued)

OTHER PUBLICATIONS

SECU4Bags User manual, 10 pages, printed from www.secu4.com, 2011.
(Continued)

*Primary Examiner* — Omar Casillashernandez
(74) *Attorney, Agent, or Firm* — Rothwell, Figg, Ernst & Manbeck, P.C.

(57) ABSTRACT

The invention relates to methods and devices for supervising a baggage item using a security device comprising at least one sensor, a processor connected to said sensor, and a communication unit connected to said processor. Said method comprises the steps of monitoring (S101), by the at least one sensor, a status of a baggage item, detecting (S102), by the processor, a change in the status of the baggage item and determining (S103), based on a detected change in the status, whether a notification is to be issued, and transmitting (S104), by the communication unit, the notification to a supervision unit.

20 Claims, 5 Drawing Sheets

(51) Int. Cl.

| | |
|---|---|
| ***G08B 13/12*** | (2006.01) |
| ***G08B 21/02*** | (2006.01) |
| ***G08B 25/08*** | (2006.01) |
| ***G08B 25/10*** | (2006.01) |
| ***G08B 13/14*** | (2006.01) |

(52) U.S. Cl.
CPC ..... *G08B 21/0263* (2013.01); *G08B 21/0266* (2013.01); *G08B 21/0269* (2013.01); *G08B 21/0272* (2013.01); *G08B 21/0275* (2013.01); *G08B 21/0277* (2013.01); *G08B 25/08* (2013.01); *G08B 25/10* (2013.01)

(58) Field of Classification Search
USPC ..... 340/571
See application file for complete search history.

(56) References Cited

U.S. PATENT DOCUMENTS

| | | | | |
|---|---|---|---|---|
| 2004/0041706 | A1 | 3/2004 | Stratmoen et al. | |
| 2004/0189466 | A1 | 9/2004 | Morales | |
| 2008/0158002 | A1* | 7/2008 | Parkinson | G08B 13/1436 340/8.1 |
| 2013/0057694 | A1* | 3/2013 | Petricoin, Jr. | H04N 7/18 348/155 |
| 2013/0234849 | A1* | 9/2013 | Gupta | G06Q 10/0833 340/539.11 |
| 2014/0002239 | A1* | 1/2014 | Rayner | G08B 13/1427 340/5.61 |
| 2014/0139334 | A1* | 5/2014 | Dubarry | A45C 5/03 340/539.1 |

FOREIGN PATENT DOCUMENTS

| | | | |
|---|---|---|---|
| EP | 2267648 | A2 | 12/2010 |
| WO | 2004114242 | A1 | 12/2004 |

OTHER PUBLICATIONS

"Loose wire blog", Bluetooth's Missing Suitcase, 2007, 3 pages.
Varias, "Suitcase That Automatically Follows Owner: Loyal Luggage" technabob, 2012, 4 pages.
Extended European Search Report dated Jan. 22, 2014, issued in European Application No. 13178057.9, 7 pages.

* cited by examiner

METHODS AND DEVICES FOR SUPERVISING BAGGAGE ITEMS

CROSS REFERENCE TO RELATED APPLICATION(S)

The present application claims priority benefit of European Application No. 13178057.9, filed on Jul. 25, 2013, the contents of which are incorporated herein by reference in its entirety.

TECHNICAL FIELD

The present invention relates to methods and devices for supervising baggage items.

BACKGROUND

Baggage items by nature undergo a risk of being stolen, being broken into for their contents being stolen, or being manipulated in other ways against their owner's will. Apparently this risk is particularly high when baggage items are left alone or taken out of hand particularly in public places like airports, railway stations and the like, but is also present when left e.g. in a hotel room.

There are known systems which are intended to protect personal items like wallets, bags or suitcases against theft. For example, GB 2 375 424 A discloses a personal items protection alarm, wherein a transponder is put inside the item to be protected and a transceiver is worn by a user. The transceiver checks that the protected object is within a preset range by emitting a return signal to the transponder, and alarms the user when the signal is not returned.

Such systems however are only suitable for protection under certain circumstances. Particularly, it is required that the item to be protected is within a certain, limited distance from its owner. Further, no protection is given if the item is not carried away, i.e. stays within the preset range, but only its contents are robbed.

SUMMARY

The aim of the present invention is thus to provide methods and devices of the aforementioned type that provide for protection against theft and other unwanted manipulation under a wider range of circumstances.

This goal is achieved by a method for supervising a baggage item using a security device comprising at least one sensor, a processor connected to said sensor, and a communication unit connected to said processor, wherein the method comprises the steps of monitoring, by the at least one sensor, a status of a baggage item, detecting, by the processor, a change in the status of the baggage item and determining, based on a detected change in the status, whether a notification is to be issued, and transmitting, by the communication unit, the notification to a supervision unit.

Therein, said security device may be capable of operating in a plurality of modes and said step of determining whether a notification is to be issued may thus be performed depending on a current mode of the security device.

The method may further comprise receiving instructions transmitted by the supervision unit in response to the notification. Said instructions may comprise instructions to ignore the detected status change or instructions to raise an alarm, and/or instructions to change a mode of the security device.

The above goal is further achieved by a security device for baggage items, comprising at least one sensor adapted to monitor a status of a baggage item, a processor connected to said sensor, wherein said processor is adapted to detect a change in the status of the baggage item and to determine, based on a detected change in the status, whether a notification is to be issued, and a communication unit connected to said processor, wherein said communication unit is adapted to transmit the notification to a supervision unit.

Apparently, said detection of a status change may be based on signals from the at least one sensor.

Therein, the at least one sensor may for example comprise at least one of an acceleration sensor, an image sensor, a position determination sensor, a motion detection sensor like e.g. an infrared sensor, a distance sensor like e.g. an ultrasound sensor, and a power plug sensor. A position determination sensor may be capable to determine an absolute position of the security device, for example by means of a satellite positioning system like GPS, and/or may be capable of determining a relative position, for example relative to the ground or relative to a user resp. a person carrying the supervision unit.

Other sensors are also conceivable, for example vibration sensor, light sensor, air pressure sensor, tension sensor, humidity sensor, temperature sensor etc. One further example is a sensor that detects opening or removal of an item like a cover, zipper, clasp or lock or the like, for example in form of a standby current sensor, wherein an electric circuit is interrupted when the item is opened or removed.

Of course, any single sensor or any combination of sensors may be used in the security device.

The communication unit of the security device may comprise a wireless communication device, i.e. a transmitter or transceiver according to any wireless communication protocol, particularly according to a cellular communication standard like GSM, UMTS, LTE, and/or any other wireless standard like WLAN and/or Bluetooth. This communication device may be used by the communication unit to transmit said notification to the supervision unit. Further, the communication device may also be used as position determination sensor; e.g. a cellular transceiver can be used to determine a position in a certain cell of a PLMN (Public Land Mobile Network). As another example, a Bluetooth transceiver may be used to determine a distance to a user resp. a person carrying the supervision unit e.g. by detecting a loss of connection or a change in signal strength beyond a predefined threshold.

The above goal is further achieved by a baggage item, comprising a security device as described above.

Further, the above goal is achieved by a supervision unit for supervising a baggage item which is adapted to establish a communication link to a security device comprised in a baggage item and to receive a notification from the security device, to evaluate the notification and to generate instructions to the security device in response to the notification, and to transmit the instructions to the security device.

In order to perform said evaluation, the supervision unit may comprise according decision logic, for example in the form of a processor, which may be a special-purpose processor like a DSP or the like or a general-purpose processor like a common CPU or the like, and which operates according to a program loaded to the processor. On the other hand it is conceivable that the supervision unit is entirely implemented as a software module which can be run on one or more processors, for example processors like the ones mentioned. In such a case, the decision logic is a software structure that is adapted to perform said evaluation.

In one example, the supervision unit may be constituted by or comprised in a mobile communication device, particularly a mobile phone.

Accordingly, the supervision unit may comprise a wireless communication device similar to the one described with respect to the security device.

In any case, the security device and/or the supervision unit may particularly be adapted to operate according to the above-described method.

The above goal is further achieved by a security system for baggage items, comprising a baggage unit, adapted to be associated with a baggage item, and a remote unit, wherein the baggage unit and the remote unit each comprise a communication unit which is adapted to establish a communication link to each other. The baggage unit further comprises at least one sensor adapted to monitor a status of the associated baggage item, a processor connected to said sensor, wherein said processor is adapted to detect a change in the status of the baggage item and to determine, based on a detected change in the status, whether a notification is to be issued. Said communication unit is connected to said processor and is adapted to transmit the notification to the remote unit.

In such a security system, the baggage unit may comprise or be constituted by a security device as described above, and/or the remote unit may comprise or be constituted by a supervision unit as described above.

Even further, the above goal is achieved by a computer program being capable, when executed by a processor, to perform the above-described method. Said computer program may further be carried by any suitable carrier, for example any storage unit like a harddisk, semiconductor memory like RAM, ROM, Flash memory or the like, optical storage like CD-ROM or DVD. Said carrier may also be an electromagnetic or optical signal which carries said computer program, for example using a modulation method as known by the ones skilled in the art.

BRIEF DESCRIPTION OF THE DRAWINGS

Further characteristics and advantages of the invention will become better apparent from the detailed description of particular but not exclusive embodiments, illustrated by way of non-limiting examples in the accompanying drawings, wherein.

DETAILED DESCRIPTION

In the following, detailed embodiments will be described in order to exemplify the above invention.

Figure 1:
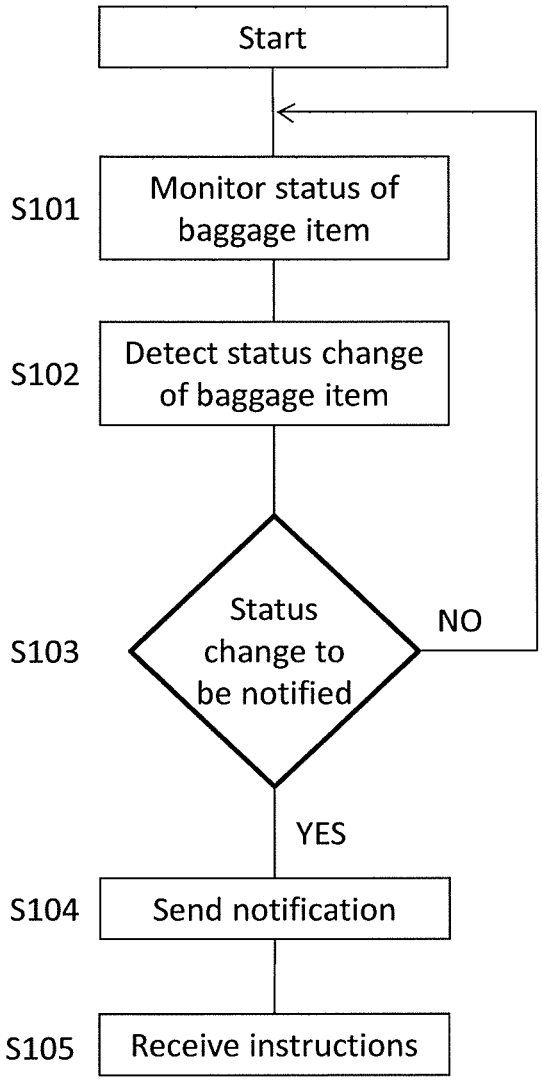
FIG. 1 is a flowchart of a method for supervising a baggage item.

With reference to the figures, FIG. 1 shows a flowchart of a method for supervising a baggage item. Such method may be performed by a security device comprising at least one sensor, a processor connected to said sensor, and a communication unit connected to said processor.

After the start, a status of the baggage item to be supervised is monitored by the at least one sensor in step S101.

A wide variety of sensors is conceivable for monitoring, for example acceleration sensor(s), image sensor(s), position determination sensor(s), motion detection sensor(s) like e.g. an infrared sensor, distance sensor(s) like e.g. ultrasound sensor(s), and a power plug sensor. Of course any type of sensor that can be useful for status monitoring is conceivable, like for example vibration sensor(s), light sensor(s), air pressure sensor(s), tension sensor(s), humidity sensor(s), temperature sensor(s) etc. One further example is a sensor that detects opening or removal of an item like a cover, zipper, clasp or lock or the like, for example in form of a standby current sensor, wherein an electric circuit is interrupted when the item is opened or removed. Therein, any single sensor or any combination of sensors may be used.

In step S102, a change in the status of the supervised baggage item is detected by the processor, based on data, measurements or other signals received from the sensor.

For example, if an acceleration sensor is employed, a change of status of the baggage item may be detected when the acceleration sensor detects a movement, represented by an acceleration value beyond a predetermined threshold. This movement may be a movement away from its original place, e.g. by lifting and/or lateral movement, and/or any in situ movement of the baggage item like tilting, jolting, vibration or similar movement. Thereby, a theft or intrusion attempt may be detected.

In a similar way, a change of status may be detected when the signal from an image sensor or infrared sensor changes, e.g. when an object not previously present can be viewed by the image sensor. This may be the case when the image sensor is inside the baggage item and is subject to a transition from "dark" to "light", for example by someone opening the baggage item, or when the image sensor monitors the baggage item from the outside and a movement of an object, which might be a person, towards the baggage item is detected.

Another means of movement detection may be provided by a position detection sensor, for example using a satellite positioning system like GPS, or position information provided by a cell of a PLMN (Public Land Mobile Network). Thereby, movement as such can be detected, or it can be detected when the baggage item leaves a certain, predefined geographical area.

In a similar way, a proximity sensor like a near field communication sensor may be employed, whereby it can be detected when the baggage item is moved away from a predefined place, like a supervision unit or the like, by a predefined distance. Such detection may for example also be accomplished by using a Bluetooth transceiver.

In any case, a relative position may be determined, for example relative to a user resp. to a person carrying a supervision unit.

It is also conceivable that a position relative to a fixed object or facility is determined, for example relative to the ground. This may be accomplished by an according sensor, like an image or infrared sensor, an ultrasound sensor or the like.

Further, a power plug sensor may be employed, wherein it may be detected when a power plug attached to the security device or to the baggage item is removed.

Of course, a plurality of sensors of the same or different types may be combined in one security device. Further, a big variety of other sensor types may be employed to detect a status change.

Based on the detected status change the processor determines, in step S103, whether a notification is to be issued, i.e. whether a condition is present which requires some kind of action, like releasing an alarm. This determination may be done based on the type and/or degree of the detected status change, e.g. by using a look-up table, comparison with a threshold or other measures well known by those skilled in the art.

For example, if the acceleration detected by an acceleration sensor or the distance to a predetermined place detected by a proximity sensor or a position detection sensor exceeds a certain threshold, it may be determined that a notification is to be issued.

It is also conceivable that, for the determination step, a plurality of sensor signals are evaluated together; for example, if an acceleration is detected by an acceleration sensor and at the same time or subsequently a change of position or increasing distance is detected, it may be determined that a notification shall be issued. By evaluating a plurality of sensors, false alarms may be reduced.

If it is, in step S103, determined that the detected status change shall not be notified, the method returns to step S101 and resumes monitoring the status of the baggage item. On the other hand, if it is determined that the detected status change shall be notified, the method proceeds to step S104, in which a notification is sent to a supervision unit. This sending may be accomplished by a communication unit of the security device. The notification may include the detected status change and/or the particular sensor signal(s) that has/have caused the notification, and/or may include a description of said sensor signal(s) or any other value derived therefrom.

The supervision unit may be any device or institution that is capable of receiving and potentially further processing of the notification, as will be described in more detail with respect to FIG. 2 further below.

In one embodiment, instructions how to react to the status change can be sent from the supervision unit to the security device and received by the security device in step S105.

Based on the instructions, the security device may perform further actions, for example raising an alarm, e.g. by emitting a loud sound, flashing lights or the like, which may alert persons in the vicinity and cause an unauthorized intruder to release or leave the supervised baggage item. These actions may also include gathering further information that may be transmitted to the supervision unit, for example taking a photo, or a video and/or audio recording of the surroundings of the supervised baggage item, or record a tracking of its position.

In one particular embodiment, the described method flow may be dependent on a current mode. This means that the supervision method, particularly the monitoring step S101 and/or the determination step S103, can act differently based on particular settings that reflect a certain supervision situation. Such situations may be characterized by whether the supervised baggage item is in the vicinity of its owner or not, whether it is in an otherwise secured area or not, and particularly which level of security is given in the particular area etc.; in general, different situations may require different measures or levels of supervision and/or different approaches of evaluating sensor signals.

For example, when a person carries the baggage item to be supervised or has it in his or her vicinity, a mode may be selected in which a relative position of the bag to its owner is supervised and evaluated, and an alarm may particularly be raised when the distance between both exceeds a certain threshold.

In another situation, the owner may give the baggage item out of hand to have it transported by other persons, for example when traveling by plane. In such a case, the distance between the bag and the owner will increase, while a certain level of security is given due to handling by airline personnel. Nevertheless, theft and/or opening of the bag shall be prevented, such that a mode may be selected in which the relative position to the owner is not supervised, or the distance threshold is substantially increased, but e.g. an image sensor inside the bag is activated in order to detect when the bag is opened.

Further, when the baggage item is placed out of sight of the owner, for example in a hotel room or the like, a further mode may be chosen, wherein an absolute position may be supervised in order to detect removal of the bag from the place it was put. Alternatively or in addition, any movement—upwards, sideways, tilt etc.—of the baggage item may be detected as this may represent a stealing attempt.

A variety of further modes, or modifications of the described modes, can be conceived, depending on the particular needs or circumstances.

The mode may be set at any time during the method flow, particularly at the start resp. before monitoring in step S101 begins. Mode setting may be accomplished by a user interaction with the security device itself, or by transmitting an according instruction by the supervision unit. Usually, a user will select a certain mode at a user interface of the supervision unit which is then transmitted to the security device; just as well, a user may define modes or adapt modes to specific needs or situations.

Further, there may be relations between modes, e.g. it may be that transitions between modes are defined such that upon occurrence of a certain, predefined situation, the mode can be changed in a predefined way. The predefined situation may be defined in terms of certain sensor events—like detection of a movement, location, proximity of the supervision unit or the like—which lead to selection of a mode which is dependent on the situation and potentially also the previous mode.

As has been described, the monitoring S101—i.e. particularly the sensor(s) used for monitoring—but also the decision S103 may be dependent on the selected mode. Thereby, the sensor signals may be interpreted or evaluated differently depending on the selected mode, for example by applying mode-dependent thresholds, joint evaluation of sensor signals or the like.

The instructions received from the supervision unit may also comprise a change of the mode. Alternatively or in addition it is conceivable that the security device itself changes mode when the determining step S103 has led to the result that the status change needs to be notified. This can for example be switching to another mode of supervision, or to a mode in which monitoring is suspended, e.g. by stopping sensor detection.

Figure 2:
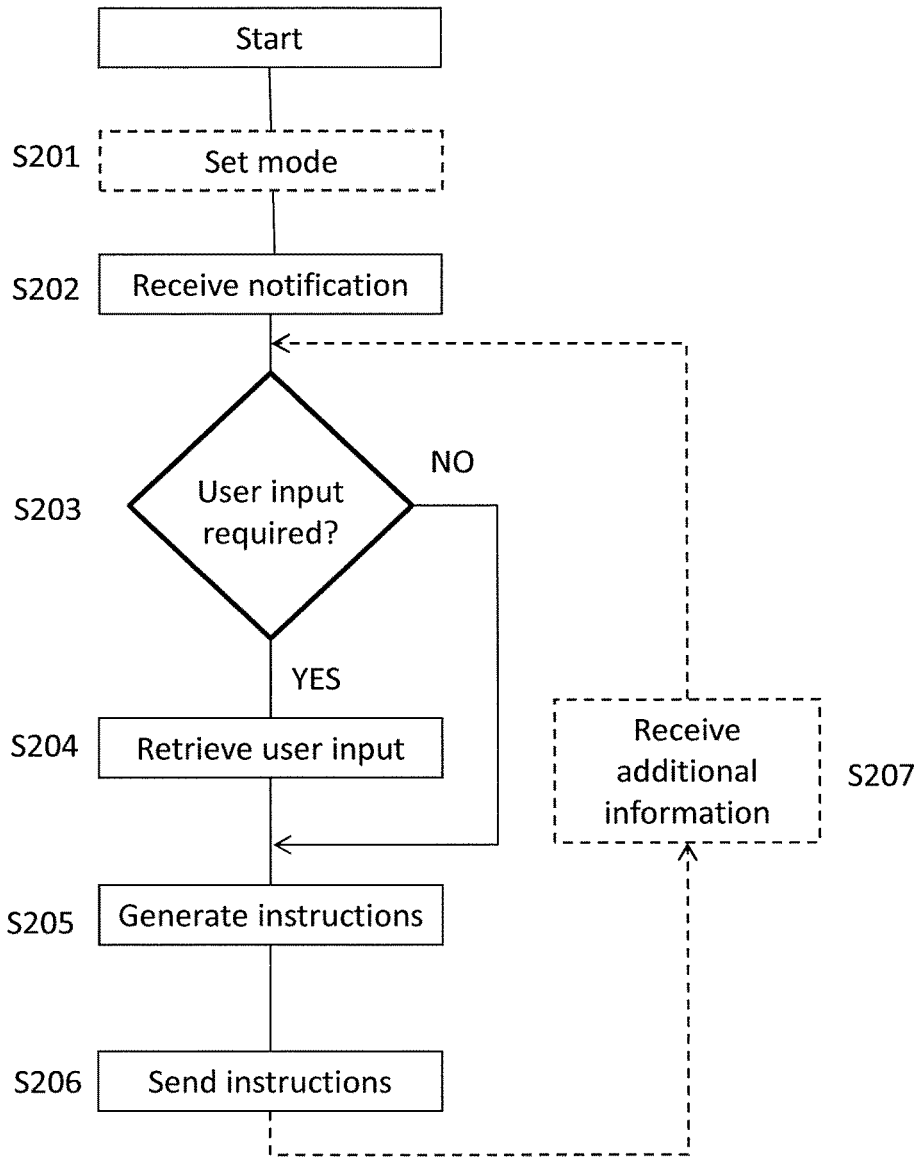
FIG. 2 is a flowchart of a method for supervising a baggage item.

FIG. 2 shows a flowchart of a method for supervising a baggage item. Such method may be performed by a supervision unit comprising a communication unit being capable to establish a communication link to a security device which is monitoring a baggage item, and a processor connected to said communication unit, and may be performed in connection with the method described in FIG. 1.

The supervision unit may be any device or institution that is capable of receiving and potentially further processing of a notification from a security device monitoring a status of a supervised baggage item. In one example, the supervision unit may be a communication device, particularly a mobile communication device, like a mobile phone, particularly a smartphone, portable computer etc., or any other communication device like a telephone, fax machine etc. In such a case, a software application may be stored and executed on the device which controls communication between the supervision unit and the security device. In another example, the supervision unit may be any type of public or private guard service. In any case, the notification may be displayed to the respective user, who can decide how to react.

In an optional step S201, a supervision mode may be set and according instructions may be sent to the security device monitoring the supervised baggage item. Mode setting may take place based on a user interaction, for example using a user interface module of the supervision unit, for example by using a graphical user interface (GUI) on a display, or based on an automatic determination based on situational parameters like location, distance between supervision unit and security device etc.

If such mode setting is performed, this may be done at any time during the flow of the method of FIG. 1, particularly however at the beginning, i.e. before starting monitoring the status of the supervised baggage item. The following steps S202 to S206 will usually be performed between steps S104 and S105 of FIG. 1.

In step S202, a notification is received that a status of a supervised baggage item has changed, for example from a security device associated with the baggage item. Said notification may for example be a notification as described with respect to FIG. 1.

Based on the information contained in the notification, the supervision unit may optionally determine in step S203 whether user input for handling the detected situation is necessary, and if necessary retrieve input from a user of the supervision unit. This may be done by means of a user interface module of the supervision unit, for example by using a graphical user interface (GUI) on a display, and/or other optical and/or acoustical interfaces. Thus, the user can decide, based on the presented information, how to handle the notification.

In any case, the user may be informed about the notification, for example by emitting a noise, lights, or vibration or any other means that may attract the attention of the user.

Based on the information contained in the notification and/or the user interaction, in step S205 instructions are generated that are sent to the security device in step S206.

Such instructions may include raising an alarm by the security device, and/or gathering further information, for example by instructing the security device to take a photo, video and/or audio recording of the surroundings of the supervised baggage item, or record a tracking of its position as described above, in order to make a final determination on how to react to the notification.

It may also be provided that a voice or video call is established between the supervision unit and the security device, wherein the user, e.g. the owner of the baggage item, can communicate with a potential unauthorized intruder.

Further, such instructions may include a command to ignore the alarm, for example when the supervision unit has determined that there is no real alarm situation.

Any information that the supervision unit receives from the security device may be evaluated automatically and/or displayed to a user of the supervision unit to let the user decide how to handle the notification.

For example, in a case where the instructions comprise gathering further information as mentioned above, the additional information may be received in an optional step S207; based thereon, basically the steps S203 to S206, or a subset thereof, may be repeated. For example, the additional information may be automatically evaluated or presented to a user of the supervision unit; based on this information, the user may decide how to handle the situation, resp. such decision can be made automatically as described further below. Finally, according instructions can be generated and sent to the security device.

The supervision unit, when receiving a notification from the security device, may also be informed on the current mode of the security device and evaluate the received information taking this mode into account, and/or notify a user of the supervision unit accordingly. As a result, the instructions transmitted to the security device may also comprise a change of the mode, which can again be user-initiated or based on automatic evaluation of the received information.

Apparently, any determination on the side of the supervision unit may take place based on the notification received from the security device, particularly based on information included therein, like information on the particular sensor signal(s) that caused the notification.

Automatic evaluation may be accomplished by generally known measures like threshold comparison, rule-based evaluation, classification algorithms or the like. Information presented to the user may be in the form of displaying the information contained in the received notification, potentially in a summarized and/or preprocessed form. This means that the "raw" information received from the security device may be brought into a form that is more easily understood by a human user, and/or indications may be added whether or how severe the notified incident is. The information may be presented to the user by means of a display, a loudspeaker or the like. In any case, the user may be alerted by a warning signal, for example an optical, acoustic or vibration signal.

Of course it is also conceivable that a user of the supervision unit actively requests status information from the security device even if no notification has been received.

Figure 3:
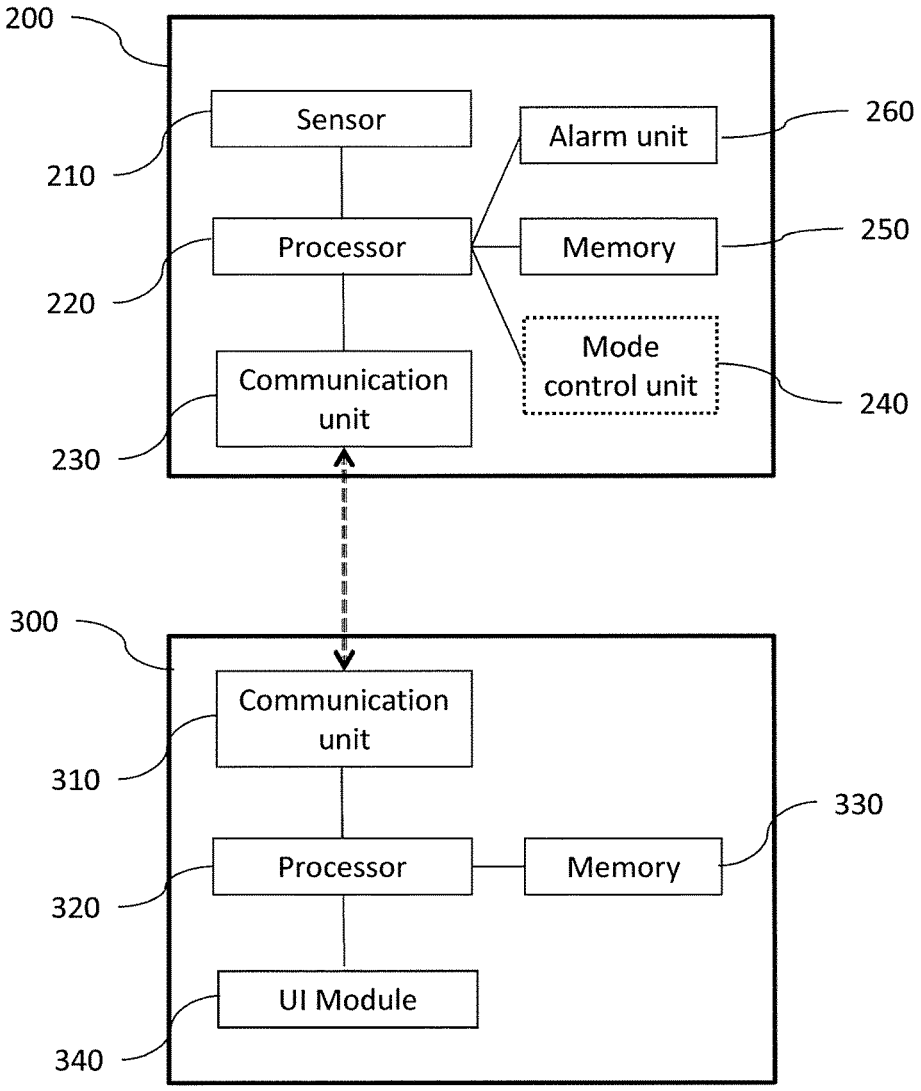
FIG. 3 is a schematic diagram of a security system for baggage items, comprising a security device and a supervision unit.

FIG. 3 shows a schematic diagram of a security system for baggage items, comprising a security device 200 and a supervision unit 300 which may be used to perform the above-described methods.

Security device 200 comprises a processor 220, to which a sensor arrangement 210, a communication unit 230, memory 250, an alarm unit 260 and optionally a mode control unit 240 are connected.

Sensor arrangement 210 may comprise one or a plurality of sensors, for example acceleration sensor(s), image sensor(s), position determination sensor(s), infrared sensor(s), power plug sensor(s), or any of the sensors mentioned further above. Again, any single sensor or any combination of sensors may be used in the security device.

A position determination sensor may be capable to determine an absolute position of the security device, for example by means of a satellite positioning system like GPS, and/or may be capable of determining a relative position, for example relative to the ground or relative to a user resp. a person carrying the supervision unit. Sensor arrangement 210 may further comprise a sensor detecting a lock state of the baggage unit, in order to detect potential unauthorized opening. Further, sensor arrangement 210 may comprise an RFID unit, which may be used to exchange information with adjacent appliances, for example a baggage transport system in an airport; such information may then be transmitted to the supervision unit 300 and be used to inform the user on the current handling state.

By means of the sensor arrangement 210, the status of a baggage item to be supervised can be monitored in the above-described way.

Processor 220 may be a special-purpose processor like a DSP or the like or a general-purpose processor like a common CPU or the like, or may comprise more than one of any such processors, and may operate according to a program loaded to the processor. Said program may be stored in memory 250, which may comprise any storage unit like a harddisk, optical storage like CD-ROM or DVD, or preferably semiconductor memory like RAM, ROM, Flash memory or the like.

By means of processor 220, the sensor data from sensor arrangement 210 are evaluated such that a status change may be detected, and it can be decided based thereon whether a notification is to be issued. Evaluation may be dependent on information or state of optional mode control unit 240 which controls operation of the processor according to a current mode, as described above. Of course it is conceivable that mode control unit 240 is represented by a computer program, which may be stored in memory 250 and also executed by processor 220.

The communication unit 230 of the security device 200 may comprise a wireless communication device, particularly a cellular transmitter resp. transceiver and/or a WLAN transmitter resp. transceiver and/or a Bluetooth transmitter resp. transceiver. This communication device may be used by the communication unit to transmit said notification to the supervision unit 300. Further, the communication device may also be used as position determination sensor; e.g. a cellular transceiver can be used to determine a position in a certain cell of a PLMN (Public Land Mobile Network). As another example, a Bluetooth transceiver may be used to determine a distance to a user resp. a person carrying the supervision unit e.g. by detecting a loss of connection or a change in signal strength beyond a predefined threshold. In a similar way, a WLAN transceiver may be used to detect removal from a certain area by detecting a loss of connection or a change in signal strength beyond a predefined threshold.

Communication unit 230 serves for providing a communication link to supervision unit 300, using any type of available connection, for example via WLAN, a PLMN, or any other communication network, and is used to transmit the above-mentioned notification to supervision unit 300 and to receive instructions from supervision unit 300.

Such received instructions can again be evaluated by processor 220, in order to determine an appropriate reaction to the detected status change. For example, an alarm can be raised using alarm unit 260, e.g. by emitting a loud sound, flashing lights or the like. Accordingly, alarm unit 260 may comprise or be connected to a loudspeaker, which may also be used for voice communication with the supervision unit 300.

As another example, further information can be gathered, depending on the received instructions, to be provided to the supervision unit. This may be done using sensor arrangement 210, e.g. by retrieving GPS data, using a camera or microphone etc. It is also conceivable that such information retrieval may be triggered by a user of the supervision unit 300 directly, i.e. without having received a notification from security device 200.

It is further conceivable that such further information is gathered automatically by security device 200 as soon as a status change has been detected (for example following step S102 of FIG. 1). This may be used for the decision process in security device 200 whether a notification is to be sent, and/or to secure evidence, e.g. an image of a potential thief or intruder, location information for tracking in case of theft etc.

Security device 200 may be built in a baggage item, like a bag, suitcase or wallet, or may be removable and thus usable in a flexible way on different items. Particularly in the latter case, security device 200 may be contained in a preferably small housing, like a plastic box, or even in a "credit card" form factor. It may be foreseen that security device 200 can be fixedly attached to the baggage item, e.g by means of a lock, and particularly in such a way that it cannot be removed without raising an alarm.

Supervision unit 300 comprises a communication unit 310 which is generally similar to the communication unit 230 of security device 200, i.e. may comprise a wireless communication device, particularly a cellular transmitter resp. transceiver and/or a WLAN transmitter resp. transceiver and/or a Bluetooth transmitter resp. transceiver, and is particularly adapted to establish a communication link to security device 200, in order to receive notifications from and send instructions to security device 200.

Said communication unit 310 is connected to processor 320, which is in turn connected to memory 330. Again, Processor 320 may be a special-purpose processor like a DSP or the like or a general-purpose processor like a common CPU or the like, or may comprise more than one of any such processors, and may operate according to a program loaded to the processor. Said program may be stored in memory 330, which may comprise any storage unit like a harddisk, optical storage like CD-ROM or DVD, or preferably semiconductor memory like RAM, ROM, Flash memory or the like.

By means of processor 320, information received from the security device 200 via communication unit 310 is evaluated, for example in the way described above with respect to FIG. 2.

If in the course of evaluation it is determined that any kind of user interaction is required, such interaction can be accomplished via UI module 340. UI module 340 may thus comprise or be connected to output means like a display and/or other means of optical output, like warning lights, loudspeaker, vibrational actuator(s) or the like, as well as input means like microphone, keyboard or keypad, touchscreen and the like.

Based on the evaluation result, a warning or alarm may be given to a user, e.g. by emitting flashing lights, warning sound, vibration or the like, and/or information regarding the detected event may be presented to the user. Optionally, input from the user on how to handle the event may be requested or accepted.

Then, based on the evaluation result and/or potential user input, instructions to the security device 200 may be generated using processor 320 and transmitted via communication unit 310.

Supervision unit 300 may be comprised in or constituted by a mobile communication device, particularly a mobile phone, mobile computer like laptop, tablet and the like. Thereby, it can easily be carried by and interact with a user, e.g. an owner of the supervised baggage item. Alternatively or in addition, supervision unit 300 may be incorporated in a service center which performs supervision for customers. In any case, supervision unit 300 may be implemented in hardware and/or software, e.g. in the form of a computer program or smartphone app.

If supervision unit 300 is incorporated in a service center, this may also be used to supervise a user of the security device 200 when in the proximity of the supervised baggage item. Thereby, a health state of the user may be detected by appropriate sensors, like a camera, and aid can be called if needed. To this end, special sensors could additionally be provided, for example a blood pressure sensor, heartbeat sensor or the like.

Further, different actions may be triggered by security device 200 if no response is received from supervision unit 300 after lapse of predetermined times. To this end, one or more timers may be implemented in security device 200 which are started upon detection of a status change (e.g. following or in step S102) or when a notification is sent to supervision unit 300 (e.g. following or in step S104). Thus, after a certain time without receiving a response resp. instructions from supervision unit 300, an according timer lapses and further actions are then triggered by security device 200. For example, an alarm (e.g. acoustic sound) can be given automatically, and/or a the notification may be forwarded to a further external emergency center in case the user of a mobile device to which the notification was sent in the first place did not react. Such emergency center may then play the role of a supervision unit as described herein, but in this special case in a two-step arrangement.

Figure 4:
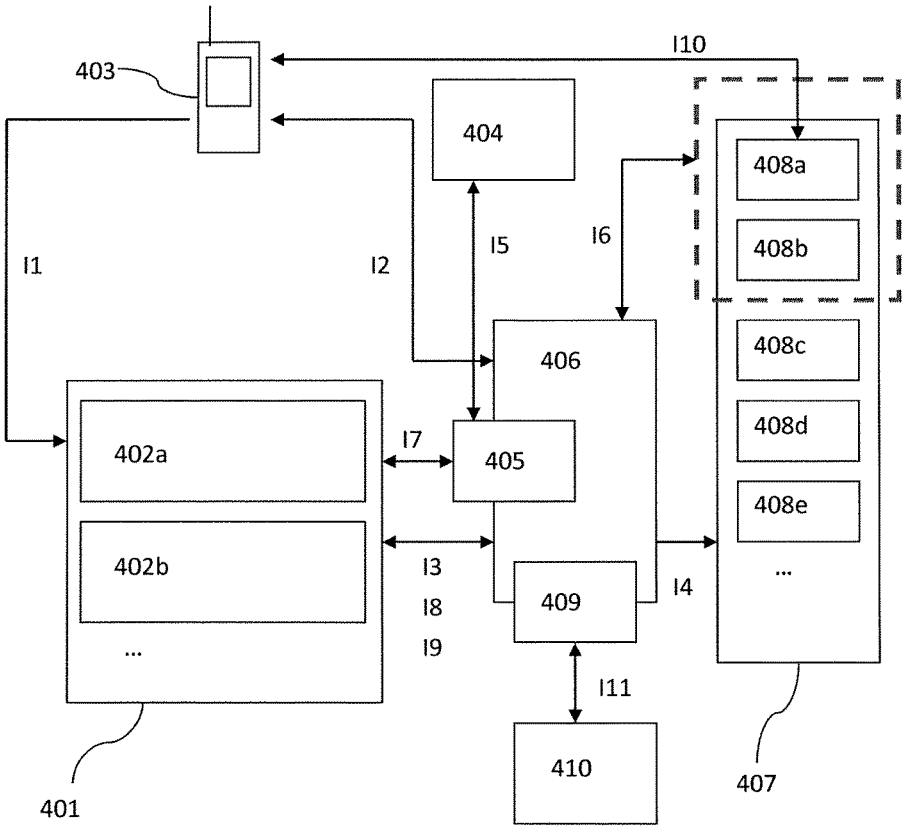
FIG. 4 is a schematic diagram of an embodiment of a security system for baggage items.

With respect to FIG. 4, a more detailed embodiment of a security system is described.

Therein, a supervision unit is depicted in the form of mobile phone 403, which may perform functions of the supervision unit as described above, for example by means of an application loaded in the memory of mobile phone 403.

Apart from that, a logical structure is shown representing an embodiment of a control structure for a security device like the one described above. This logical structure comprises several logical modules as well as interfaces between them and between modules and the mobile phone 403. Such logical structure may for example be implemented in form of software that is executed by one or more processors, potentially employing further units like input/output, communication with external devices and so on.

The control structure comprises a mode module 401, wherein a number of sensor modes 402*a*, 402*b*, . . . are defined, which may be seen as logical combination of different sensor systems packed as a mode. Mode module 401 has an interface I7 to a bridge module 405 which may serve as a mode control unit 240 as described with respect to FIG. 3. For example, via interface I7 a sensor mode may be selected by bridge module 405. This mode selection may be influenced by external parameters, for example received from external input module 404 via interface I5, which detects environmental parameters and appliances, for example presence of a WLAN access point in the vicinity. Bridge module 405 is part of warning state module 406, and thus mode selection may also be based on a current warning state.

On the other hand, a manual mode selection is possible from mobile phone 403 via interface I1.

Warning state module 406 receives input from mode module 401 via interface I3 and may evaluate the received sensor signals in order to determine whether a warning or alarm is to be raised. Depending on the result of the determination, warning state module 406 can instruct mode module 401 via interface I8 to switch back to the old state, i.e. continue monitoring, or via interface I9 to switch to a new state, for example stop monitoring, and/or to change the sensor mode.

If determination results in a warning, warning state module 406 may notify mobile phone 403 thereof via interface I2, as described above. Further, warning state module may instruct alarm module 407 via interface I4 to perform actions to handle the warning. In order to accomplish this, alarm module 407 comprises (logical) action packages 408*a*, 408*b*, . . . which initiate according actions. This may for example be emitting an alarm by light, sound etc., and/or to establish a connection to mobile phone 403 via interface I10 over which camera signals or voice communication can be transmitted.

Further, warning state module 406 may retrieve further information from alarm module 407 via interface I6. Thereby, certain action packages may be activated which may be helpful for a warning decision, like camera, location data and the like.

Of course it is also conceivable that manual action triggering is initiated from mobile phone 403 via interface I10.

In addition, there may be an interface I11 to an external alarm handling, for example in a supervision service center. Via interface I11, for example access can be given to camera supervision module 409, which may automatically start a camera and/or audio recording once a warning state is determined by warning state module 406.

Figure 5:
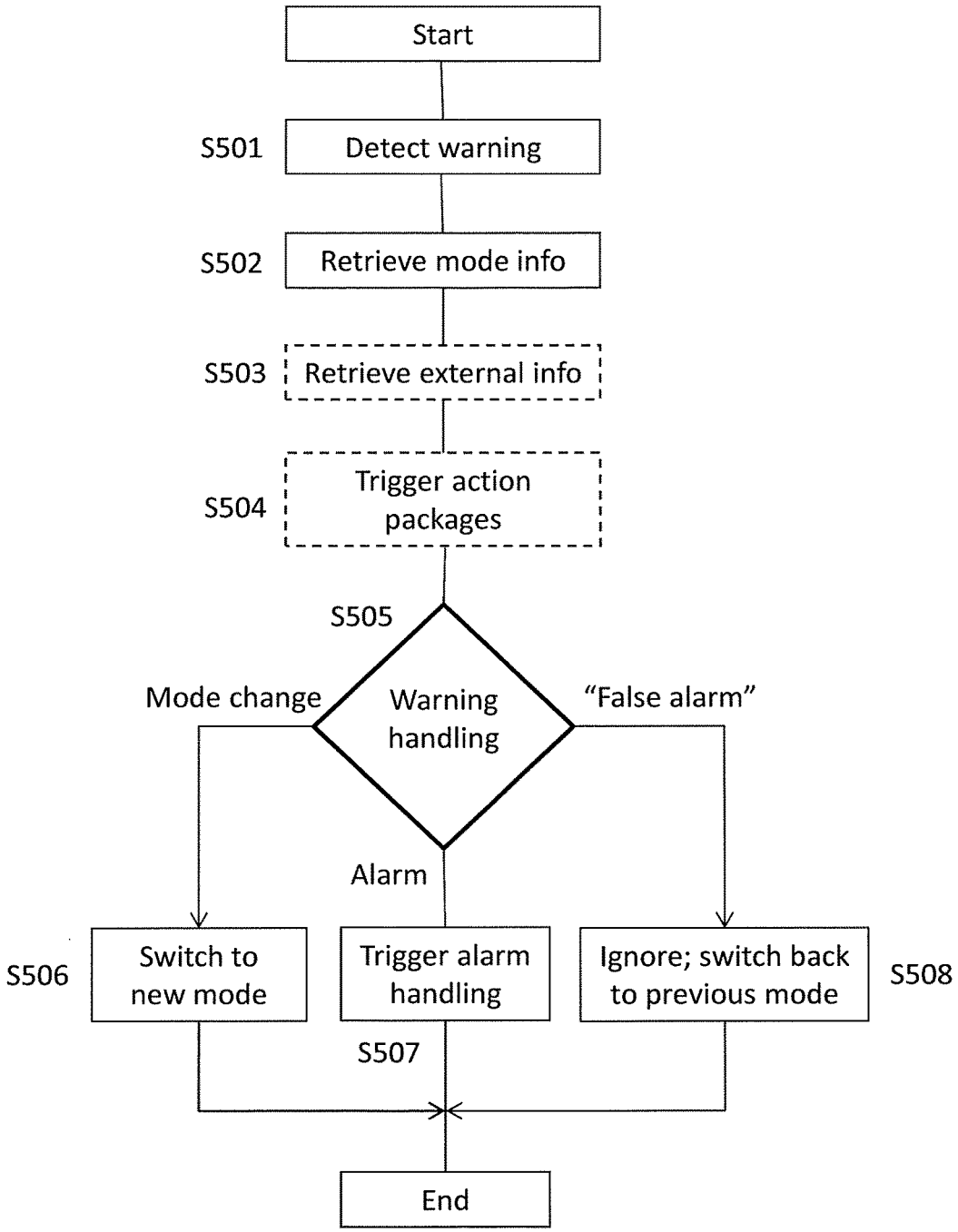
FIG. 5 is a flowchart of a decision process in a method for supervising a baggage item.

A flow chart showing a decision process in a method for supervising a baggage item is shown in FIG. 5. Such decision process may for example be performed in the course of the method described with respect to FIG. 1, and/or may be executed in warning state module 406.

After detection of a warning, e.g. by according sensor signals, in step S501, further information for supporting a decision is gathered in the following steps.

In step S502, mode information is retrieved, for example from mode module 401 or bridge module 405. Then, external information representing environmental parameters may be retrieved in step S503, for example from external input module 404.

Action packages may be triggered in step S504, wherein further sensor or other information is requested, for example from alarm module 407. Further, these action packages may include sending a notification regarding the warning to a supervision unit, and the response resp. instructions received from the supervision unit may be used in the following decision step S505. Of course it is also conceivable that received instructions trigger activation of further action packages, e.g. to gather additional information as requested from the supervision unit.

Based on the gathered information and/or instructions from a supervision unit, it is decided how to handle the warning in step S505, wherein particularly a determination is made whether an alarm situation is given or not.

If there is no alarm situation, i.e. the warning is found to be a "false alarm", this is ignored and it is switched back to the previous mode, e.g. continue monitoring, in step S508, and the decision process ends.

If there is an alarm situation, alarm handling is triggered in step S507, which may for example result in the above-mentioned measures like creating a loud sound etc. Particularly, but not only, in case there already was interaction with a supervision unit in step S504, alarm handling may include transmitting a notification and/or further information to a supervision unit.

Further, it may be switched to a new mode in step S506. This mode change may be done automatically, e.g. based on the gathered information and/or by applying an according set of rules, or taking into account instructions received from a supervision unit.

A decision process as described with respect to FIG. 5 may for example be performed by a security device as described with respect to FIG. 3 and may be employed in a supervision method as described with respect to FIG. 1, for example in connection with decision step S103.

In the following, an exemplary use case in which the above systems, devices and methods are used, will be described:

It is assumed that a suitcase, representing a baggage item, is to be supervised, wherein the baggage item comprises a security device as described above.

Assume that at the beginning the suitcase is in a "Self surveillance (non attendance) mode" 402*a*, which means, that the suitcase it far away from the owner resp. from his smartphone/mobile phone 403. This can be e.g. a situation, when the owner is at the beach and the suitcase is in the hotel room. The suitcase is locked by different sensor systems (e.g. motion detection, power-plugin-control, acceleration sensor . . . ) as described above.

The owner is now coming from the beach and takes the suitcase to drive to the airport. The sensors give a warning via interface I3 because the suitcase is moved. The warning module 406 is provided, via interface I7, with the bridge information on the 'old' sensor mode 402*a*. Bridges define possible switch options from one sensor mode to another, as not all possible combinations makes sense. Let's assume that the only bridge (i.e. transition) from "Self surveillance (non attendance) mode" is to sensor mode 402*b* "Attendance mode". This "Bridge", or transition, is shown in the display of the smartphone as an option, after the smartphone has indicated to the owner that the sensor(s) has/have produced a warning. Other options that can manually be chosen, are "Ignore" and "Alarm". The owner selects, via interface I2, the option "Switch to Attendance mode", so the owner chose the bridge optionality, which is transmitted to mode module 401 via interface I9.

"Attendance mode" may mean that an acceleration sensor is logically combined with a distance check mode (for example Bluetooth or WiFi). So a warning is given in the case that the distance between owner and suitcase is too large (exceeding a predefined threshold, e.g. >10 meter), and a warning is given if the suitcase is moved but not by the owner, which may be detected by a sensor combination of an acceleration sensor ("MOVE") and a distance sensor, when the distance exceeds another predefined threshold, for example >2 meter).

The owner goes to the toilet and leaves the suitcase under the table. He get a warning (suitcase moved; owner not in distance e.g. <2 meter). Over interface I6 he triggers an action package action 408*a* to display the integrated camera picture on the smartphone. This action is done to get additional information, to evaluate the situation in the warning status more detailed. He detects, that the waiter has hit the suitcase by mistake. So he clicks on "Ignore" (false alarm), which is transmitted to the warning state module 406 via interface I2 and therefrom to the mode module via interface I8. Then he takes the suitcase (no warning is detected, because the suitcase is moved by owner) and enters the airport.

He delivers the suitcase in the check in, but forgets to switch manually to the "Flight Mode". Because he is still in the "Attendance mode", the warning is displayed on his smartphone, because the distance sensor detects a distance exceeding a threshold, e.g. >10 meter. According to this example, there are two possible bridges (transitions), notified over interface I7 to the warning state module, for sensor mode "Attendance mode": One bridge to "Self surveillance (non attendance) mode" and one to "Flight Mode". For example, the owner choses "Flight Mode" via a touchscreen of a smartphone incorporating or constituting a supervision unit.

"Flight Mode" may mean, that all systems are down except e.g. a GPS detection. In such a case it may be possible to input the foreseen arrival time (via GUI by the user, or based on a calendar), so that the GPS must be just started some time, e.g. 10 minutes, before the arrival time. So if the suitcase is at the arriving airport and leaves the plane, it detects GPS and goes in warning status. External input system 404 can give e.g. the additional info, that the suitcase can detect the airport WiFi system. Over interface I6 the owner triggers on the smartphone via interface I10 an action package 408*b* to fetch the GPS data. So now he can be sure, that his suitcase is at the same airport as he is. Then, it may be that only available given bridge (transition) is "Suitcase Detection Mode". The owner chose this mode and waits in the hall for his luggage. He is not required to stand at the conveyor belt, but may just wait until the suitcase is getting in his Bluetooth or WiFi range (Distance Check system). Then he gets a warning on the smartphone. The suitcase is coming on the conveyor belt, he fetches it and takes the offered bridge option to switch to "Attendance mode".

In this special case the switch could even be done automatically, because there is only one offered bridge option that makes sense, and the "Attendance mode" ensures that the suitcase is near to the owner (e. g. within a range of 2 m).

This example thus shows how the steps S502 and S503 can influence the handling and the display on the GUI of the mobile phone. More specifically, it is conceivable that location information, e.g. the information about being on the airport, can also be fetched automatically in step S502 or S503, e.g. by obtaining GPS data. So the above described bridge to "Suitcase Detection Mode" or "Attendance mode" can be displayed as 'preferred' (e.g. big button) or even made automatically.

As is apparent from the above, the disclosed devices and methods improve baggage security by providing flexible and powerful supervision means; further, they can be used to increase convenience in baggage handling during travel.

Clearly, several modifications will be apparent to and can be readily made by the skilled in the art without departing from the scope of the present invention. Therefore, the scope of the claims shall not be limited by the illustrations or the preferred embodiments given in the description in the form of examples.

The invention claimed is:

1. A method for supervising a baggage item using a security device comprising at least one sensor, a processor connected to said sensor, and a communication unit connected to said processor, said method comprising the steps of:

monitoring, by the at least one sensor, a status of the baggage item;

detecting, by the processor, a change in the status of the baggage item;

based on the detected change in the status, determining whether a notification is to be issued depending on a current mode of the security device, wherein the security device is capable of operating in a plurality of modes, wherein each of the plurality of modes comprising a specific combination of active sensors, evaluation rules, and actions to be taken, and wherein the evaluation rules include mode-dependent thresholds and joint evaluation of the active sensor signals;

transmitting, via the communication unit, the notification to a supervision unit, wherein the notification includes: (i) an indication of the current mode of the security device, (ii) the detected status change, (iii) a particular sensor signal that has caused the notification, and (iv) a description of said sensor signal; and receiving, via the communication unit, instructions transmitted by the supervision unit in response to the notification, wherein the instructions comprise an indication to change the current mode of the security device based on an evaluation of the notification.

2. The method according to claim 1, wherein said instructions further comprise at least one or more of instructions to ignore the detected status change, instructions to raise an alarm, and instructions to provide further information.

3. The method according to claim 2, wherein the instructions to provide further information include instructing the security device to take at least one of a photo, a video and an audio recording of surroundings of the supervised baggage item.

4. The method according to claim 1, wherein the plurality of modes includes at least one of Self-Surveillance mode, Attendance mode, Flight Mode, and Suitcase Detection Mode.

5. A security device for baggage items, comprising:

at least one sensor adapted to monitor a status of a baggage item;

a processor connected to said sensor, said processor being adapted to detect a change in the status of the baggage item and to determine, based on a detected change in the status, whether a notification is to be issued depending on a current mode of the security device, wherein the security device is capable of operating in a plurality of modes, wherein each of the plurality of modes comprising a specific combination or selection of active sensors, evaluation rules, and actions to be taken, and wherein the evaluation rules include mode-dependent thresholds and joint evaluation of the active sensor signals; and a communication unit connected to said processor, said communication unit being adapted to:

transmit the notification to a supervision unit, wherein the notification includes: (i) an indication of the current mode of the security device, (ii) the detected status change, (iii) a particular sensor signal that has caused the notification, and (iv) a description of said sensor signal, and receive instructions transmitted by the supervision unit in response to the notification, wherein the instructions comprise an indication to change the current mode of the security device based on an evaluation of the notification.

6. The security device according to claim 5, wherein the communication unit comprises a wireless communication device including at least one or more of a cellular transmitter, a WLAN transmitter, and a Bluetooth transmitter.

7. The security device according to claim 5, wherein the at least one sensor comprises at least one of an acceleration sensor, an image sensor, a position determination sensor, a motion detection sensor, an ultrasound sensor, and a power plug sensor.

8. The security device according to claim 5, being adapted to operate by:

monitoring, by the at least one sensor, a status of a baggage item;

detecting, by the processor, a change in the status of the baggage item and determining, based on a detected change in the status, whether a notification is to be issued; and transmitting, by the communication unit, the notification to a supervision unit.

9. The security device accordingly to claim 5, wherein a baggage item comprises the security device.

10. A supervision unit for supervising a baggage item in a wireless communication device, the supervision unit comprising:

a processor; and a memory coupled to the processor, wherein the processor is configured to:

establish a communication link to a security device comprised in a baggage item and to receive a notification from the security device, wherein the notification includes: (i) an indication of a current mode of the security device, (ii) a detected status change, (iii) a particular sensor signal that has caused the notification, and (iv) a description of said sensor signal;

evaluate the notification and identify possible mode switch options based on the current mode;

select a mode from the possible mode switch options automatically or display the possible mode switch options to a user of the supervision unit enabling the user to decide handling of the notification;

generate instructions to the security device in response to the automatic mode selection or the user input; and transmit the instructions to the security device, wherein the instructions comprise an indication to change the current mode of the security device.

11. The supervision unit of claim 10, wherein the instructions further comprise at least one or more of: instructions to ignore a detected status change, instructions to raise an alarm, and instructions to provide further information.

12. The supervision unit according to claim 10, wherein the supervision unit is constituted by or comprised in a mobile communication device.

13. A security system for baggage items, comprising:

a baggage unit, adapted to be associated with a baggage item; and a supervision unit, wherein the baggage unit and the supervision unit each comprising a communication unit adapted to establish a communication link to each other, the baggage unit further comprising:

at least one sensor adapted to monitor a status of the associated baggage item, and a processor connected to said sensor, the processor configured to:

detect a change in the status of the baggage item and to determine, based on a detected change in the status, whether a notification is to be issued depending on a current mode of the baggage unit, wherein the baggage unit is capable of operating in a plurality of modes, wherein each of the plurality of modes comprising a specific combination of active sensors, evaluation rules, and actions to be taken, and wherein the evaluation rules include mode-dependent thresholds and joint evaluation of the active sensor signals, transmit, via the communication unit, the notification to the supervision unit, wherein the notification includes: (i) an indication of the current mode of the baggage unit, (ii) the detected status change, (iii) a particular sensor signal that has caused the notification, and (iv) a description of said sensor signal, and receive, via the communication unit, instructions transmitted by the supervision unit in response to the notification, wherein the instructions comprise an indication to change the current mode of the baggage unit based on an evaluation of the notification.

14. The security system according to claim 13, wherein the supervision unit is adapted to:

establish a communication link to a security device comprised in the baggage item and to receive the notification from the security device;

evaluate the notification and generate the instructions in response to the notification; and transmit the instructions to the security device.

15. A computer program product for supervising a baggage item using a security device comprising at least one sensor, a processor connected to said sensor, and a communication unit connected to said processor, the computer program comprising a non-transitory computer readable medium storing computer instructions, which when executed by said processor, causes said processor to:

monitor, using the least one sensor, a status of the baggage item;

detect a change in the status of the baggage item;

based on the detected change in the status, determine whether a notification is to be issued depending on a current mode of the security device, wherein the security device is capable of operating in a plurality of modes, wherein each of the plurality of modes comprising a specific combination of active sensors, evaluation rules, and actions to be taken, and wherein the evaluation rules include mode-dependent thresholds and joint evaluation of the active sensor signals;

transmit, via the communication unit, the notification to a supervision unit, wherein the notification includes: (i) an indication of the current mode of the security device, (ii) the detected status change, (iii) a particular sensor signal that has caused the notification, and (iv) a description of said sensor signal; and receive, via the communication unit, instructions transmitted by the supervision unit in response to the notification, wherein the instructions comprise an indication to change the current mode of the security device based on an evaluation of the notification.

16. The method according to claim 1, wherein a change of the current mode is initiated automatically based on at least one or more of sensor input, sensor information, location information, change of location, and an evaluation rule for one or more of sensor input, sensor information, location information, and change of location.

17. The security device according to claim 5, wherein a change of the current mode is initiated automatically based on at least one or more of sensor input, sensor information, location information, change of location, and an evaluation rule for one or more of sensor input, sensor information, location information, and change of location.

18. The security system according to claim 13, wherein a change of the current mode of the baggage unit is initiated automatically based on at least one or more of sensor input, sensor information, location information, change of location, and an evaluation rule for one or more of sensor input, sensor information, location information, and change of location.

19. A method for supervising a baggage item using a security device comprising at least one sensor, a processor connected to said sensor, and a first communication unit connected to said processor, said method comprising the steps of:

monitoring, by the at least one sensor, a status of the baggage item;

detecting, by the processor, a change in the status of the baggage item;

based on the detected change in the status, determining whether a notification is to be issued;

establishing a communication link between the first communication unit of the security device to a second communication unit of a supervision unit;

transmitting the notification to the security unit, wherein the notification includes: (i) an indication of a current mode of the security device, (ii) the detected status change, (iii) a particular sensor signal that has caused the notification, and (iv) a description of said sensor signal, wherein the security device is capable of operating in a plurality of modes comprising a specific combination or selection of active sensors, evaluation rules, and actions to be taken, wherein a transition to the current mode from another one of the plurality of modes involves employing different sensors depending on the status, changing the evaluation rules of the sensor signals, and changing the actions to be taken, and wherein the changed evaluation rules enable the sensor signals to be evaluated differently according to the current mode, the changed evaluation rules including mode-dependent thresholds and joint evaluation of the sensor signals; and receiving instructions transmitted by the supervision unit in response to the notification, wherein the instructions comprise an indication to change the current mode of the security device based on an evaluation of the notification.

20. The method according to claim 3, further comprising the steps of:

in response to the instructions, transmitting, via the communication unit, at least one of a photo, a video, and an audio recording of the surroundings of the supervised baggage to the supervision unit; and receiving, via the communication unit, instructions transmitted by the supervision unit in response to the at least one of a photo, a video, and an audio recording of the surroundings of the supervised baggage.

* * * * *